United States Patent [19]

Ewald

[11] 4,279,988

[45] Jul. 21, 1981

[54] PHOTOGRAPHIC FILM UNIT

[75] Inventor: William P. Ewald, Webster, N.Y.

[73] Assignee: Eastman Kodak Company, Rochester, N.Y.

[21] Appl. No.: 112,269

[22] Filed: Jan. 15, 1980

[51] Int. Cl.[3] ..... G03C 1/48; G03C 1/76

[52] U.S. Cl. ..... 430/499; 430/207; 430/209; 430/210; 430/496; 430/497

[58] Field of Search ..... 430/207, 209, 210, 496, 430/497, 499

[56] References Cited

U.S. PATENT DOCUMENTS

| | | | |
|---|---|---|---|
| 3,195,434 | 7/1965 | Dietz | 430/497 |
| 3,607,284 | 9/1971 | Harvey | 430/496 |
| 3,615,541 | 10/1971 | Hubert | 430/496 |

*Primary Examiner*—Richard L. Schilling
*Attorney, Agent, or Firm*—M. S. Sales

[57] ABSTRACT

In accordance with the present invention, a photographic film unit suitable for exposure and self-processing includes a substantially rigid mount having a central opening therethrough. A premounted film element is supported in the opening recessed between the mount's front and rear surfaces. A strippable cover sheet extends across the front of the film element to form a space for spreading processing liquid. A film support plug is received in the central opening rearwardly of the film element to inhibit the processing liquid from causing the film element to bow away from the cover sheet when the processing liquid is spread. In a preferred embodiment of the present invention, the film unit further includes a stripping sheet having a mask portion between the film element and the cover sheet, a backing sheet on the rear surface of the mount overlying the central opening, and a hinge portion interconnecting the mask portion and the backing sheet. The stripping sheet is opaque, but has an opening in its mask portion in alignment with the opening in the mount. The film support plug is adhered to the backing sheet so that the plug is removed from the mount when the backing sheet is stripped.

9 Claims, 3 Drawing Figures

PHOTOGRAPHIC FILM UNIT

BACKGROUND OF THE INVENTION

1. Field of the Invention

This invention relates generally to photographic film units suitable for exposure and self-processing, and particularly to such film units including a premounted photosensitive film element which is exposed, processed and viewed in a slide mount.

2. Description of the Prior Art

Film units including a film element, a slide mount, a cover sheet and a container of processing liquid are known in the prior art. For example such film units, wherein certain parts are manually stripped away leaving a completely processed transparency mounted for projection are described in U.S. Pat. No. 3,195,434 which issued July 20, 1965 to M. S. Dietz.

In the film units described in the Dietz patent, the film element is retained between front and rear, rigid mount sections. After exposure, the film is passed between a pair of compressive rollers to rupture the processing liquid container and to spread the liquid between the film element and the cover sheet.

The Dietz patent recognized that undue thickness or marked changes in thickness between the film element and the cover sheet must be avoided to insure an even and consistent liquid spreading operation, and disclosed a slide mount wherein one side of the rear frame member is temporarily removed so that the bottom compressive roller may approach the film element unobstructed. After processing, the missing side of the bottom frame member is manually applied by the operator.

SUMMARY OF THE INVENTION

In accordance with the invention, a photographic film unit suitable for exposures in and withdrawal from a camera is constructed to be substantially ready for viewing or projection after only a simple manipulation to remove certain parts. Novel structural features of the film unit cooperate with other components of the complete film unit and with self-developing camera apparatus to insure a uniform processing liquid spreading thickness across the exposed film component.

In a preferred embodiment of the invention, a photographic film unit includes a substantially rigid mount having a central opening therethrough. A premounted film element is supported in the opening spaced from the mount's rear surface. A strippable cover sheet extends across the front of the film element to form a confined region for spreading processing liquid. A film support plug is received in the central opening rearwardly of the film element to inhibit displacement of the film element by processing liquid pressure when the processing liquid is spread.

The film unit may further include an opaque stripping sheet having a mask portion between the film element and the cover sheet, a backing sheet portion on the rear surface of the mount overlying the central opening, and a hinge portion interconnecting the mask and the backing sheet portions. The stripping sheet has an opening in its mask portion in alignment with the opening in the mount. The film support plug is adhered to the backing sheet so that the plug is removed from the mount when the backing sheet is stripped.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENTS

While photographic film units in accordance with the present invention include structure which is herein specifically described as having a preferred form, it is to be understood that such structure (including the photosensitive film and cooperating means for effecting the exposure and processing of the film specifically described herein) may take other forms well known to those of ordinary skill in the art. Other apparatus which may be used with these film units such as for example cameras, viewers and projectors, may not be specifically shown or described herein, but may take various forms known in the art.

Figure 1:
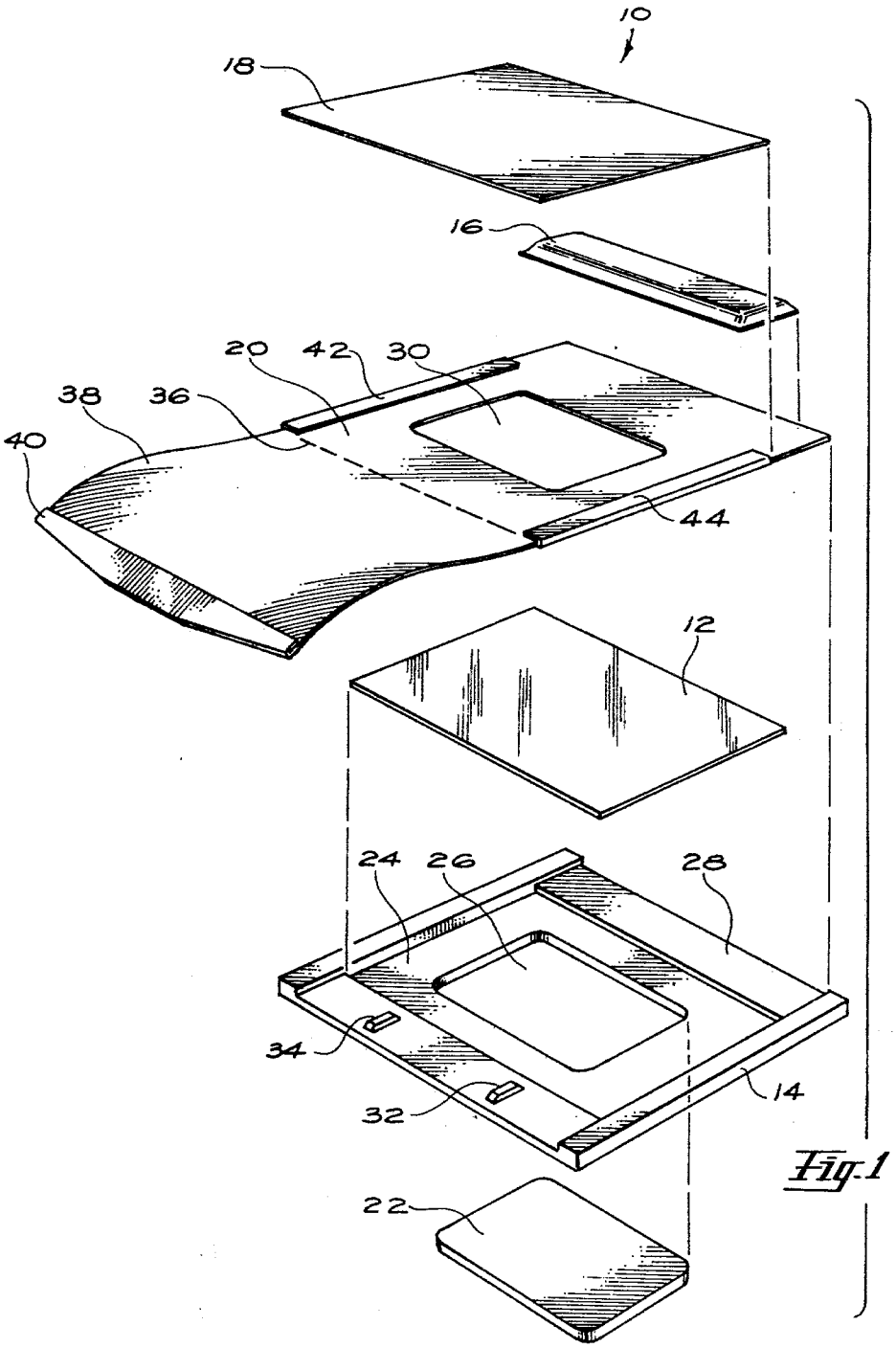
FIG. 1 is a view in exploded perspective of a photographic film unit in accordance with the present invention.

FIG. 1 shows a photographic film unit 10 in exploded perspective. The film unit is adapted to be loaded into a camera with a plurality of similar film units in a light-tight cartridge or magazine (not shown). Film unit 10 includes a film element 12, a mount (also referred to in the art as a frame) 14, a container 16 of a processing liquid, a front cover sheet 18, a stripping sheet 20 and a rear film support plug 22. The terms "front" and "rear" are used in this specification and appendant claims with reference to the orientation of the film unit during actual use in a camera. That is, the front of the film unit would face along the camera's optical axis in a direction toward the taking lens.

Film element 12 is selectable from those known in the art, such as for example as disclosed in Research Disclosure, Article 15162, pages 75–87, November 1976, which publication is hereby incorporated into this specification.

After photographic exposure, the processing liquid is released from container 16, as through the application of a compressive force to external surfaces of the film unit, to imbibe the liquid into predetermined layers of film element 12, including at least one silver halide emulsion layer. An image is formed by the diffusion transfer of image-forming substances to a transparent image-receiving layer of the film element.

Figure 2:
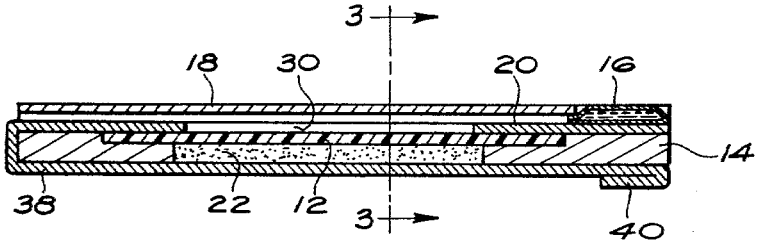
FIG. 2 is a sectional view taken through the assembled film unit of FIG. 1.
Figure 3:
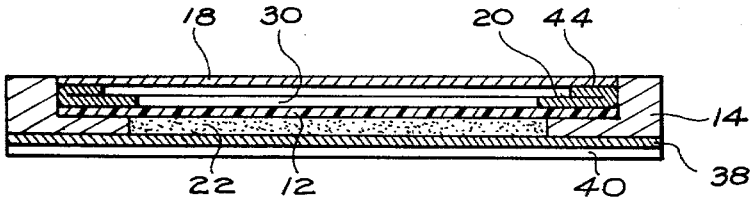
FIG. 3 is a sectional view taken along line 3—3 in FIG. 2.

FIGS. 2 and 3 are orthogonal cross-sectional views of the assembled film unit of FIG. 1. Film element 12 is received in a recess 24 in the front of mount 14 in alignment with an aperture 26. Stripping sheet 20, which is opaque, is received by a shallower recess 28 in mount 14 and has an opening 30 to form a mask for the image area. A pair of spacers 32 and 34 (FIG. 1) hold sheet 20 away from the recessed front surface of mount 14 to form a trap for processing liquid as will be explained.

Sheet 20 is folded at 36 to wrap around mount 14 and form an opaque backing sheet 38. The free end of backing sheet 38 has a folded tab 40 and is adhered to film support plug 22. Also, the lateral edges of stripping sheet 20 are folded over to form spacer rails 42 and 44.

The illustrated embodiment of film unit 10 is adapted for use in automatic, self-processing cameras wherein the film unit is advanced through a pair of driven rollers by camera mechanism, either manually or motor powered. For use in cameras without driven film unit advance mechanisms, a pull tab could be added to the leading end of the film unit to extend through an aperture of the camera where it can be grasped manually.

The film units of the present invention are intended to be supplied stacked in a magazine and covered by an opaque dark slide. Once loaded in a camera, the dark slide can be stripped, leaving the stacked film units aligned with the camera's optical axis. Upon actuation of the camera's exposure apparatus, scene light transmitted by transparent cover sheet 18 passes through opening 30 in stripping sheet 20 to impinge upon photosensitive film element 12. Transmission of light completely through the film unit, which would cause fogging of the succeeding units in the stack, is prevented by opaque backing sheet 38.

After exposure, a film unit 10 is withdrawn from the camera through a pair of pressure rollers, not shown but well known in the art, the leading edge being the edge of the film unit where container 16 is located. Progressive compression of the film unit between the rollers ruptures container 16 to release the processing liquid and spread it between cover sheet 18 and the film element 12.

The thickness of the layer of process liquid covering the film element is accurately controlled by the combined thickness of stripping sheet 20 and spacer rails 42 and 44. Because film element 12 is supported by support plug 22, it will not bulge or bow rearwardly, and the processing of liquid layer will have a controlled thickness across the film element. This contributes to the spreading of an even and complete layer of liquid.

To prevent spillage of any excess processing liquid from the trailing edge of film unit 10, spacers 32 and 34 lift the pressure rollers to create a trap which captures and holds such excess between cover sheet 18 and stripping sheet 20.

After film unit 10 is removed from the camera and processing is completed, the unwanted portions of the film unit are stripped from mount 14. Those portions include stripping sheet 20, exhausted liquid container 16, backing sheet 38 with its attached film support plug 22, and front cover sheet 18. Film element 12 includes a transparent stripping layer, not shown but known in the art, which is also removed with sheet 20, taking with it any processing liquid residue in front of film element 12.

To effect the stripping operation, the user would hold the film unit in one hand and unfold peel tab 40 with the other. As the user pulls the tab, backing sheet 38 separates from mount 14, taking film support plug 22 with it. Eventually, stripping sheet 20, cover sheet 18 and a container 16 are also removed, leaving only mount 14 and film element 12.

Although the invention has been described with particular reference to a preferred embodiment thereof, it will be readily understood that variations and modifications can be effected within the spirit and scope of the invention as described hereinabove and as defined in the appended claims.

I claim:

1. A photographic film unit suitable for exposure and processing with processing liquid, said unit comprising:

a substantially rigid mount having front and rear surfaces and a central opening therethrough;

a film element supported in the opening and spaced from the rear surface of said mount, said film element being viewable, after it has been exposed and processed, by light transmitted therethrough;

a strippable cover sheet on said mount extending across and in front of said film element to form a confined region between said film element and said sheet for receiving processing liquid, said cover sheet being adapted to transmit light to said film element;

means for admitting processing liquid between said film element and said cover sheet; and a film support plug in said central opening between said film element and the rear surface of said mount for inhibiting displacement of said film element by the processing liquid.

2. A photographic film unit as claimed in claim 1 wherein said film support plug substantially fills the central opening on the rear side of said film element.

3. A photographic film unit suitable for exposure and processing with processing liquid, said unit comprising:

a substantially rigid mount having front and rear surfaces and a central opening therethrough;

a film element supported in the opening and spaced from the rear surface of said mount, said film element being viewable, after it has been exposed and processed, by light transmitted therethrough;

a stripping sheet on the front surface of said mount and having an opening substantially coextensive with the opening in said mount a cover sheet on said stripping sheet lying across and in front of said film element to form a space between said element and said sheet for receiving processing liquid, said cover sheet being adapted to transmit light to said film element;

means for admitting processing liquid between said film element and said cover sheet; and a film support plug in said central opening between said film element and the rear surface of said mount for inhibiting displacement of said film element relative to said cover sheet by the processing liquid.

4. A photographic film unit as claimed in claim 3 wherein said stripping sheet is opaque.

5. A photographic film unit as claimed in claim 3 further comprising a container for processing liquid and a pair of spacer rails between said stripping sheet and said cover sheet.

6. A photographic film unit suitable for exposure and processing with processing liquid, said unit comprising:

a substantially rigid mount having front and rear surfaces and a central opening therethrough;

a film element supported in the opening and spaced from the front and rear mount surfaces, said film element being viewable, after it has been exposed and processed, by light transmitted therethrough;

a stripping sheet carried by said mount, said stripping sheet having (1) a mask portion on the front surface of said mount with an opening substantially coextensive with the opening in the mount, (2) an opaque backing sheet on the rear surface of said mount overlying the opening in the mount and (3) a connecting portion interconnecting said mask portion and backing sheet;

a cover sheet on said mask portion lying across and in front of said film element to form a space between said film element and said cover sheet for receiving processing liquid, said cover sheet being adapted to transmit light to said film element;

means for admitting processing liquid between said film element and said cover sheet; and a film support plug in said central opening between said film element and the rear surface of said mount for inhibiting the processing liquid from causing said film element to bow away from said cover sheet.

7. A photographic film unit as claimed in claim 6 wherein said film support plug and said backing sheet are an integral unit.

8. A photographic film unit as claimed in claim 7 wherein said film support plug is adhered to said backing sheet.

9. A photographic film unit suitable for exposure and processing with processing liquid, said unit comprising:

a substantially rigid mount having opposed first and second surfaces and a central opening therethrough;

a film element supported in the opening and spaced from the second surface of said mount, said film element being viewable, after it has been exposed and processed, by light transmitted therethrough;

a strippable cover sheet on said mount extending across said film element adjacent to the first surface of said mount to form a confined region between said film element and said sheet for receiving processing liquid;

means for admitting processing liquid between said film element and said cover sheet; and a film support plug in said central opening between said film element and the second surface of said mount for inhibiting displacement of said film element by the processing liquid.

* * * * *